US011326328B2

(12) United States Patent
Boldt

(10) Patent No.: US 11,326,328 B2
(45) Date of Patent: May 10, 2022

(54) TUBELESS SPRAYER ASSEMBLY

(71) Applicant: Thomas Boldt, Watertown, TN (US)

(72) Inventor: Thomas Boldt, Watertown, TN (US)

( * ) Notice: Subject to any disclaimer, the term of this patent is extended or adjusted under 35 U.S.C. 154(b) by 371 days.

(21) Appl. No.: 16/675,318

(22) Filed: Nov. 6, 2019

(65) Prior Publication Data

US 2021/0131081 A1 May 6, 2021

(51) Int. Cl.
*B05B 15/658* (2018.01)
*E03C 1/04* (2006.01)
*B05B 9/04* (2006.01)

(52) U.S. Cl.
CPC ..... *E03C 1/04* (2013.01); *B05B 9/0403* (2013.01); *B05B 15/658* (2018.02)

(58) Field of Classification Search
CPC ... B05B 15/658; B05B 9/0403; E03C 1/0402; E03C 2001/0416; E03C 1/04; A45D 19/04; E03D 9/085; B60R 15/02
USPC ..... 239/332
See application file for complete search history.

(56) References Cited

U.S. PATENT DOCUMENTS 5,097,540 A 3/1992 Lovitt
5,150,841 A 9/1992 Silvenis
5,423,102 A 6/1995 Madison
5,649,334 A 7/1997 Henriquez
5,970,572 A 10/1999 Thomas
6,792,956 B2 * 9/2004 Bredo ..... E04H 4/1654 134/10
6,820,821 B2 * 11/2004 Linstedt ..... A47K 3/281 239/222.11
7,021,494 B2 * 4/2006 Mazooji ..... A47K 3/281 222/181.1
7,337,989 B1 * 3/2008 Penner ..... A47K 3/281 239/263.1
2009/0256004 A1 * 10/2009 Hornsby ..... A61L 2/24 239/302
2013/0161409 A1 6/2013 Harwood
2017/0318951 A1 * 11/2017 Taghvai ..... A46B 9/04

* cited by examiner

*Primary Examiner* — Chee-Chong Lee

(57) ABSTRACT

A tubeless sprayer assembly includes a base that is coupled to a support surface. The base has a fluid port is integrated therein. The fluid port is fluidly coupled to a fluid source wherein the fluid port is configured to receive a fluid from the fluid source. A canister is positionable in the base. The canister is in fluid communication with the fluid port when the canister is positioned in the base to fill the canister with the fluid. A pumping unit is coupled to the canister. The pumping unit pumps the fluid outwardly from the canister when the pumping unit is turned on to facilitate the fluid to be sprayed without a connection to the fluid source.

13 Claims, 5 Drawing Sheets

TUBELESS SPRAYER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sprayer devices and more particularly pertains to a new sprayer device for spraying water near a sink without a water hose.

(2) Description of Related Art Including Information Disclosed Under 37 CFR 1.97 and 1.98

The prior art relates to sprayer devices.

BRIEF SUMMARY OF THE INVENTION

An embodiment of the disclosure meets the needs presented above by generally comprising a base that is coupled to a support surface. The base has a fluid port is integrated therein. The fluid port is fluidly coupled to a fluid source wherein the fluid port is configured to receive a fluid from the fluid source. A canister is positionable in the base. The canister is in fluid communication with the fluid port when the canister is positioned in the base to fill the canister with the fluid. A pumping unit is coupled to the canister. The pumping unit pumps the fluid outwardly from the canister when the pumping unit is turned on to facilitate the fluid to be sprayed without a connection to the fluid source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
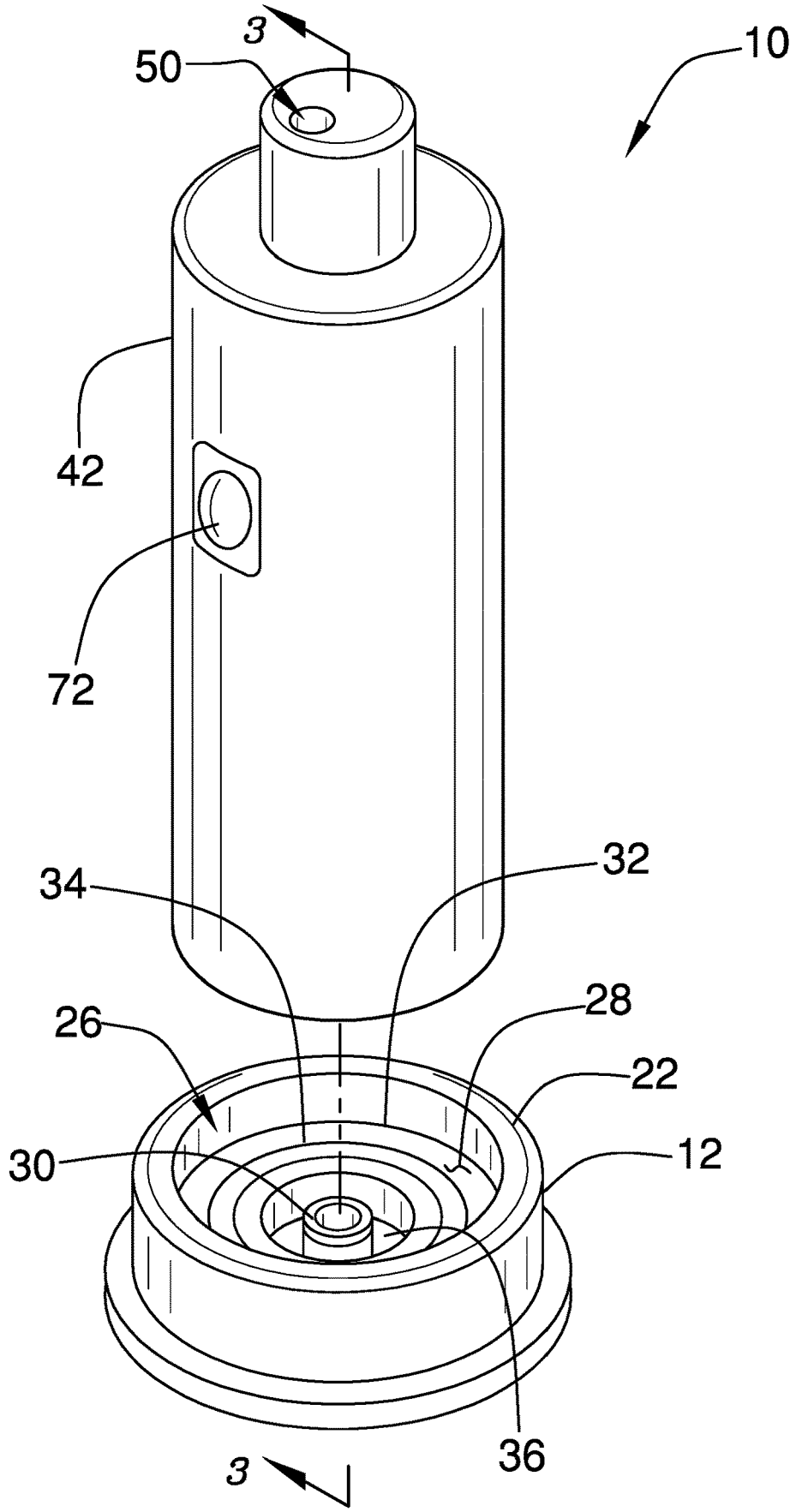
FIG. 1 is a perspective view of a tubeless sprayer assembly according to an embodiment of the disclosure.
Figure 2:
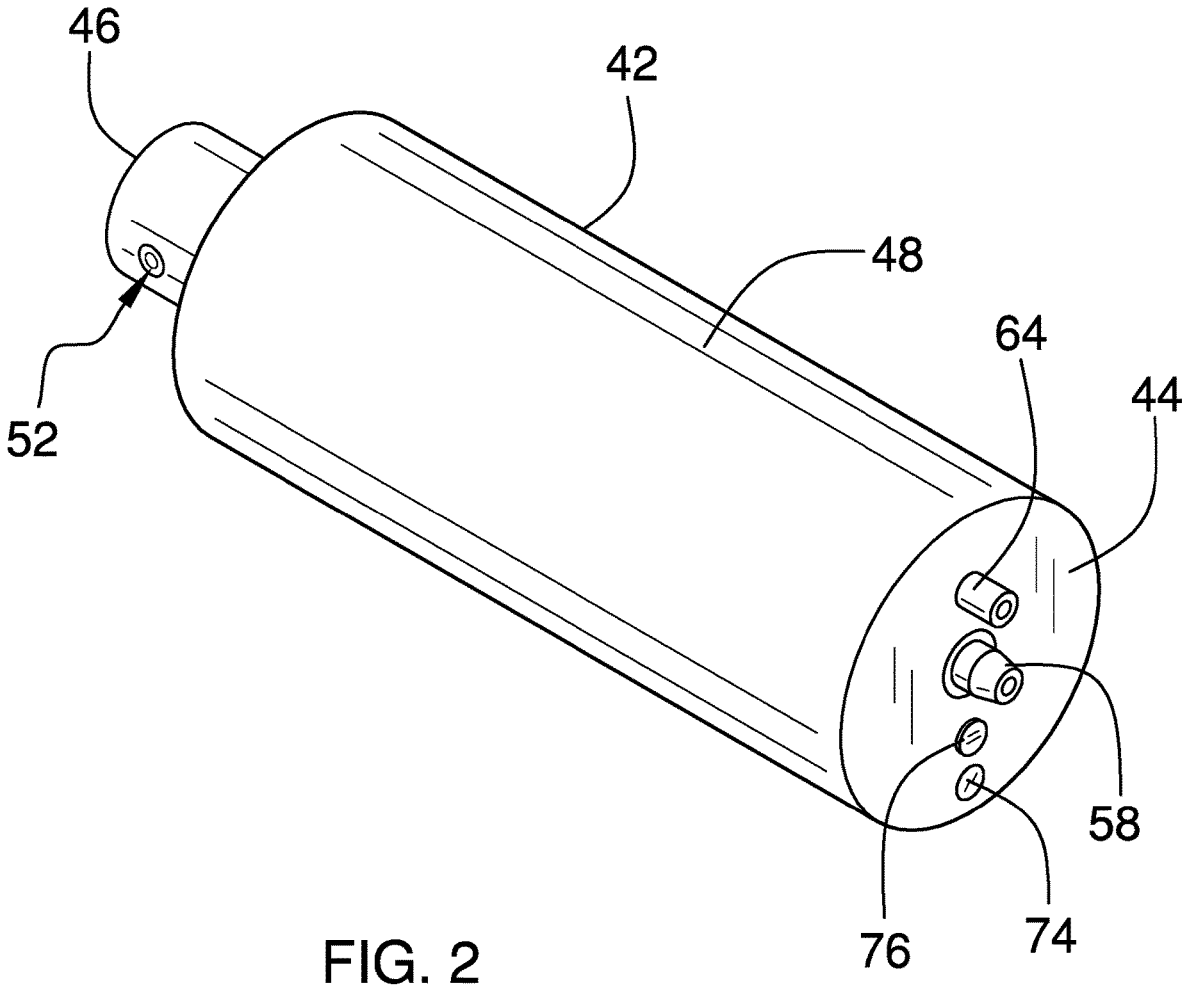
FIG. 2 is a bottom perspective view of canister of an embodiment of the disclosure.
Figure 3:
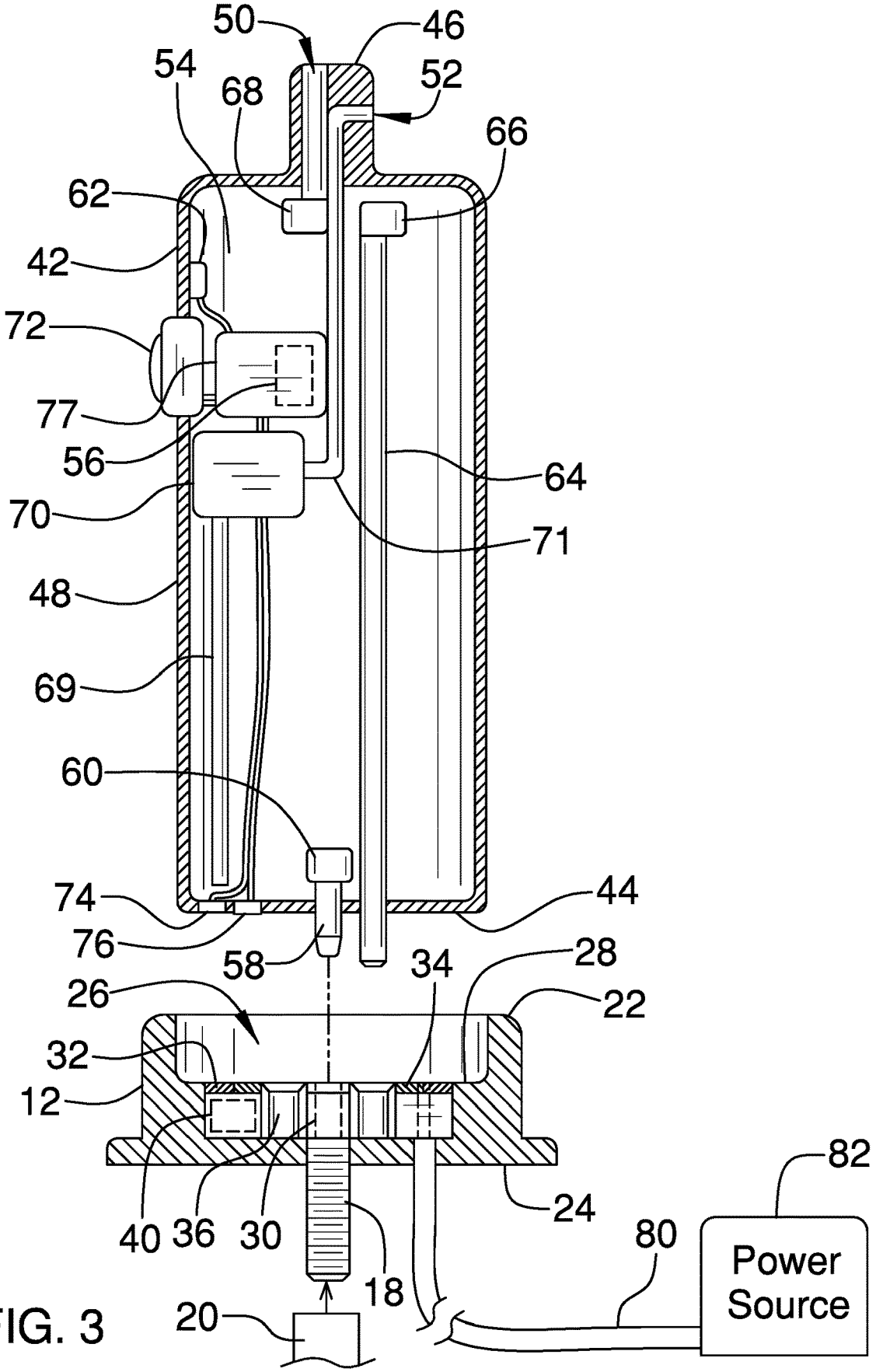
FIG. 3 is a cross sectional view taken along line 3-3 of FIG. 1 of an embodiment of the disclosure.
Figure 4:
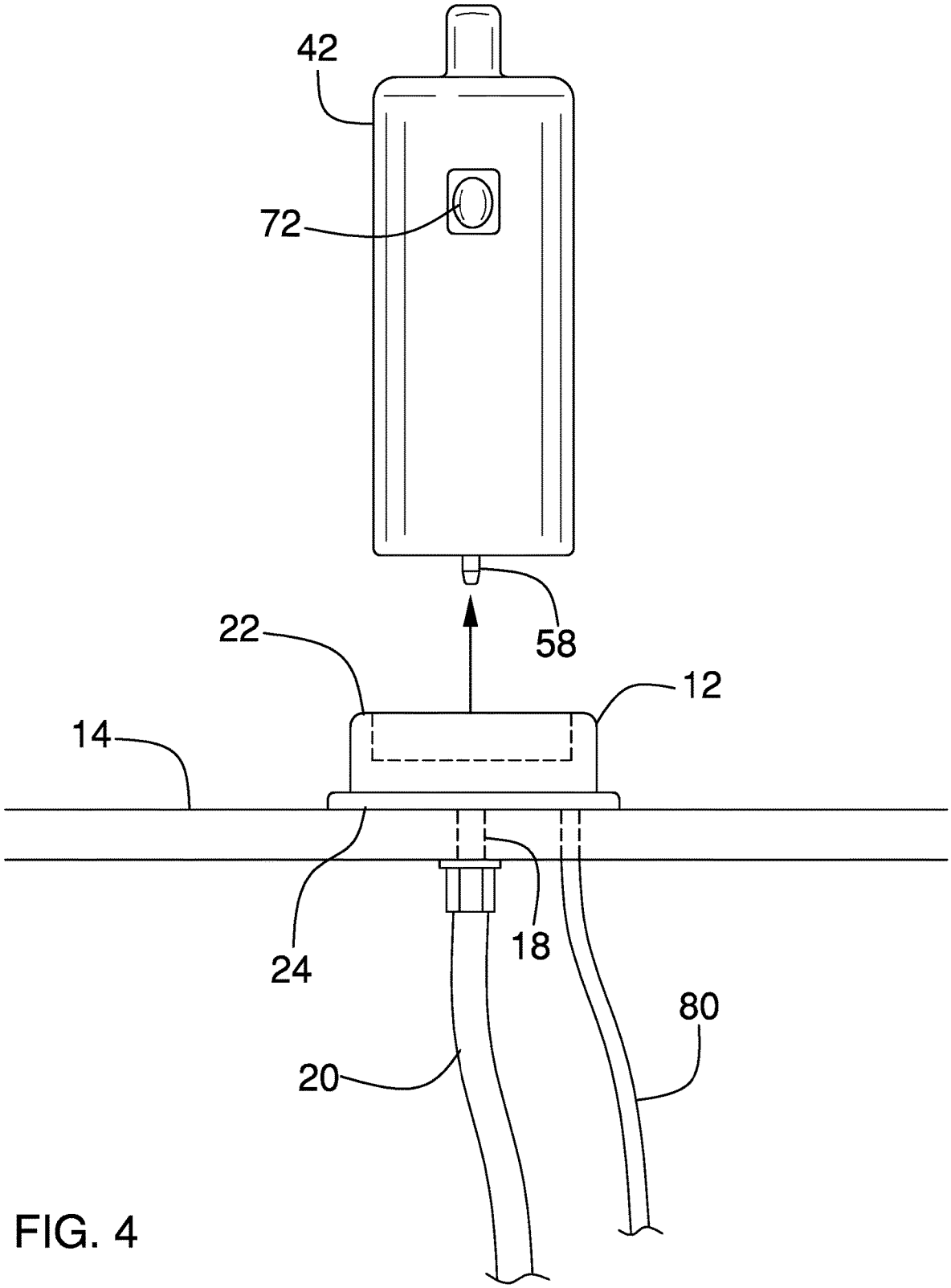
FIG. 4 is an exploded view of an embodiment of the disclosure.
Figure 5:
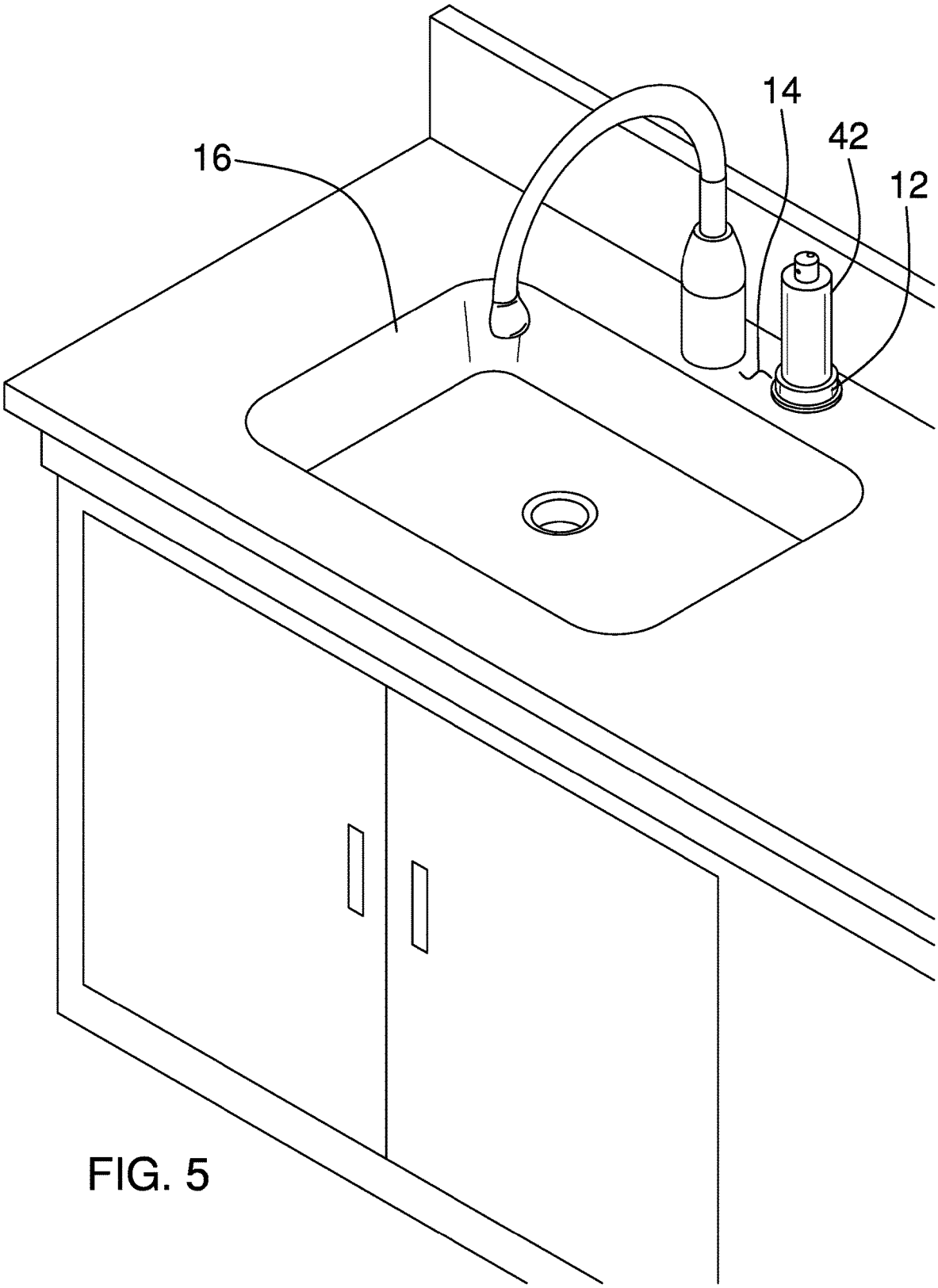
FIG. 5 is a perspective in-use view of an embodiment of the disclosure.

With reference now to the drawings, and in particular to FIGS. 1 through 5 thereof, a new sprayer device embodying the principles and concepts of an embodiment of the disclosure and generally designated by the reference numeral 10 will be described.

As best illustrated in FIGS. 1 through 5, the tubeless sprayer assembly 10 generally comprises a base 12 that is coupled to a support surface 14 having the base 12 is positioned adjacent to a sink 16. The sink 16 may be a kitchen sink or other similar plumbing fixture. The base 12 has a fluid port 18 that is integrated therein and the fluid port 18 is fluidly coupled to a fluid source 20. The fluid source 20 may be a water line and the fluid may be water. The base 12 has a top side 22 and a bottom side 24, and the top side 22 has a well 26 extending toward the bottom side 24. The well 26 has a lower bounding surface 28 and the fluid port 18 extends through the bottom side 24 and the lower bounding surface 28.

A fluid valve 30 is coupled to the base 12 and the fluid valve 30 is in fluid communication with the fluid port 18. The fluid valve 30 closes the fluid port 18 when the fluid valve 30 is turned off and the fluid port 18 opens the fluid port 18 when the fluid valve 30 is turned on. A first base contact 32 is coupled to the lower bounding surface 28 of the well 26 and the first base contact 32 surrounds the fluid port 18. A second base contact 34 is coupled to the lower bounding surface 28 of the well 26 and the second base contact 34 surrounds the fluid port 18. The fluid valve 30 is electrically coupled to each of the first base contact 32 and the second base contact 34. Each of the first base contact 32 and the second base contact 34 are comprised of an electrically conductive material.

An air release valve 36 is integrated into the base 12 and the air release valve 36 is aligned with the lower bounding surface 28 of the well 26. Additionally, the air release valve 36 restricts air from flowing outwardly therethrough in a first direction. The air release valve 36 may be a one way air valve or the like. A contact sensor 40 is coupled to the base 12 and the contact sensor 40 is electrically coupled to the first base contact 32. The contact sensor 40 may comprise a switch or other electronic sensor that is capable of detecting when an object is positioned in the well 26.

A canister 42 is provided and the canister 42 is positionable in the base 12. The canister 42 is in fluid communication with the fluid port 18 when the canister 42 is positioned in the base 12 to fill the canister 42 with the fluid. The canister 42 has a bottom wall 44, a top wall 46 and an outer wall 48 extending therebetween. The bottom wall 44 rests on the lower bounding surface 28 of the well 26 when the canister 42 is positioned in the base 12. The canister 42 has an air input 50 extending through the outer wall 48 into an interior of the canister 42. The canister 42 has a fluid output 52 extending through the outer wall 48 into the interior of the canister 42. The bottom wall 44 of the canister 42 engages the contact sensor 40 when the canister 42 is positioned in the well 26 in the base 12. The canister 42 may have a fluid capacity of at least 6.0 fluid ounces.

A pumping unit 54 is coupled to the canister 42 and the pumping unit 54 pumps the fluid outwardly from the canister 42 when the pumping unit 54 is turned on. In this way the pumping unit 54 facilitates the fluid to be sprayed without a connection to the fluid source 20. The pumping unit 54 comprises a control circuit 56 that is coupled to the canister 42. The control circuit 56 receives a fill input and an off input. The pumping unit 54 includes a fill spout 58 that extends through the bottom wall 44 of the canister 42. The fill spout 58 is fluidly coupled to the fluid port 18 in the base 12 when the canister 42 is positioned in the well 26 in the base 12 for filling the canister 42 with the fluid.

The pumping unit 54 includes a fill valve 60 that is fluidly coupled to the fill spout 58. The fill valve 60 is positioned within the canister 42 and the fill valve 60 passes fluid in only one direction when the fill valve 60 is turned on. In this way the fill valve 60 inhibits fluid from exiting the canister 42 through the fill spout 58. The fill valve 60 is in a closed condition when the fill valve 60 is turned off. The fill valve 60 is electrically coupled to the control circuit 56. Moreover, the fill valve 60 is turned on when the control circuit 56 receives the fill input and does not receive the off input. The fill valve 60 is turned off when the control circuit 56 receives the off input. The fill valve 60 may be an electrically controlled fluid valve 30 or the like.

The pumping unit 54 includes a fluid sensor 62 that is positioned within the canister 42. The fluid sensor 62 is positioned adjacent to the top wall 46 of the canister 42 and the fluid sensor 62 is fluidly coupled to the control circuit 56. The control circuit 56 receives the off input when the fluid sensor 62 senses fluid. The fluid sensor 62 may comprise an electronic water sensor or the like.

An air exhaust tube 64 is positioned in the canister 42 and the air exhaust tube 64 extends through the bottom wall 44 of the canister 42. The air exhaust tube 64 is fluidly coupled to the air release valve 36 when the canister 42 is positioned in the well 26 in the base 12. The air exhaust tube 64 exhausts air from within the canister 42 when the canister 42 is filled with fluid. An exhaust valve 66 is fluidly coupled to the air exhaust tube 64. The exhaust valve 66 is positioned within the canister 42 and the exhaust valve 66 is positioned adjacent to the top wall 46 of the canister 42. The exhaust valve 66 passes air in only one direction to inhibit air from entering the canister 42 through the air exhaust tube 64. Moreover, the exhaust valve 66 is positioned closer to the top wall 46 of the canister 42 than the fluid sensor 62 such that the canister 42 ceases being filled with the fluid before the fluid level reaches the exhaust valve 66. The exhaust valve 66 may be a one way air valve or the like and the exhaust valve 66 facilitates air to exit the canister 42 when the canister 42 is being filled with the fluid.

An intake valve 68 is positioned within the canister 42 and the intake valve 68 is in fluid communication with the air input 50 in the outer wall 48 of the canister 42. The intake valve 68 passes air in only one direction to inhibit air from exiting the canister 42 through the air input 50. The intake valve 68 may be a one way air valve or the like.

The pumping unit 54 includes a pump 70 that is positioned within the canister 42. The pump 70 has an inlet 69 and an exhaust 71, and the inlet 69 of the pump 70 draws fluid inwardly therein when the pump 70 is turned on. The exhaust 71 of the pump 70 is fluidly coupled to the fluid output 52 in the outer wall 48 of the canister 42. In this way the fluid is sprayed outwardly from the fluid output 52 when the pump 70 is turned on. The pump 70 is electrically coupled to the control circuit 56 and the pump 70 may be an electric fluid pump or the like. A button 72 is movably coupled to the outer wall 48 of the canister 42 and the button 72 is electrically coupled to the control circuit 56. The pump 70 is turned on when the button 72 is depressed and the pump 70 is turned off when the button 72 is released. The intake valve 68 facilitates air to enter the canister 42 when the fluid is sprayed outwardly from the canister 42.

A first canister contact 74 is coupled to the bottom wall 44 of the canister 42 and the first canister contact 74 is electrically coupled to the control circuit 56. The first canister contact 74 is in electrical communication with the first base contact 32 when the canister 42 is positioned in the well 26 in the base 12. The first canister contact 74 is comprised of an electrically conductive material. A second canister contact 76 is coupled to the bottom wall 44 of the canister 42 and the second canister contact 76 is electrically coupled to the control circuit 56. The second canister contact 76 is in electrical communication with the second base contact 34 when the canister 42 is positioned in the well 26 in the base 12. Additionally, the second canister contact 76 is comprised of an electrically conductive material.

The control circuit 56 receives the fill input when the first canister contact 74 engages the first base contact 32, when the second canister contact 76 engages the second base contact 34 and when the canister 42 engages the contact sensor 40. A power supply 77 is positioned within the canister 42, the power supply 77 is electrically coupled to the control circuit 56 and the power supply 77 comprises at least one rechargeable battery. The power supply 77 includes a power cord 80 that is coupled to the base 12 and the power cord 80 is electrically coupled to a power source 82. The power source 80 may be a battery charger or other power source for charging the power supply 77. The power cord 80 is electrically coupled to each of the first base contact 32 and the second base contact 34. In this way the at least one battery in the canister 42 can be charged when the canister 42 is positioned in the base 12.

In use, the canister 42 is inserted into the well 26 in the base 12 thereby facilitating the canister 42 to be filled with the fluid. The canister 42 is removable from the base 12 and the button 72 on the canister 42 is depressed to turn on the pump 70. In this way the fluid is sprayed outwardly from the canister 42 thereby facilitating the fluid to be sprayed without having a hose connected to the sink 16. The canister 42 is refilled with the fluid each time the canister 42 is placed on the base 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tubeless sprayer assembly being configured to be positioned adjacent to a sink for spraying water, said assembly comprising:

a base being coupled to a support surface having said base being positioned adjacent to a sink, said base having a fluid port being integrated therein, said fluid port being fluidly coupled to a fluid source wherein said fluid port is configured to receive a fluid from the fluid source;

a canister being positionable in said base, said canister being in fluid communication with said fluid port when said canister is positioned in said base to fill said canister with the fluid;

a pumping unit being coupled to said canister, said pumping unit pumping the fluid outwardly from said canister when said pumping unit is turned on wherein said pumping unit is configured to facilitate the fluid to be sprayed without a connection to the fluid source;

wherein said base has a top side and a bottom side, said top side having a well extending toward said bottom side, said well having a lower bounding surface, said fluid port extending through said bottom side and said lower bounding surface; and;

wherein said assembly includes a fluid valve being coupled to said base, said fluid valve being in fluid communication with said fluid port, said fluid valve closing said fluid port when said fluid valve is turned off, said fluid port opening said fluid port when said fluid valve is turned on;

a first base contact being coupled to said lower bounding surface of said well, said first base contact surrounding said fluid port; and a second base contact being coupled to said lower bounding surface of said well, said second base contact surrounding said fluid port, said fluid valve being electrically coupled to each of said first base contact and said second base contact;

an air release valve being integrated into said base, said air release valve being aligned with said lower bounding surface of said well, said air release valve restricting air from flowing therethrough in a first direction;

a contact sensor being coupled to said base, said contact sensor being electrically coupled to said first base contact;

wherein said canister has a bottom wall, a top wall and an outer wall extending therebetween, said bottom wall resting on said lower bounding surface of said well when said canister is positioned in said base, said bottom wall of said canister engaging said contact sensor when said canister is positioned in said well in said base;

wherein said canister has an air input extending through said outer wall into an interior of said canister; and wherein said canister has a fluid output extending through said outer wall into said interior of said canister.

2. The assembly according to claim 1, wherein said pumping unit comprises a control circuit being coupled to said canister, said control circuit receiving a fill input and an off input.

3. The assembly according to claim 2, further comprising:

a fill spout extending through said bottom wall of said canister, said fill spout being fluidly coupled to said fluid port in said base when said canister is positioned in said well in said base for filling said canister with the fluid; and a fill valve being fluidly coupled to said fill spout, said fill valve being positioned within said canister, said fill valve passing fluid in only one direction when said fill valve is turned on wherein said fill valve is configured to inhibit fluid from exiting said canister through said fill spout, said fill valve being in a closed condition when said fill valve is turned off, said fill valve being electrically coupled to said control circuit, said fill valve being turned on when said control circuit receives said fill input and does not receive said off input, said fill valve being turned off when said control circuit receives said off input.

4. The assembly according to claim 2, further comprising a fluid sensor being positioned within said canister, said fluid sensor being positioned adjacent to said top wall of said canister, said fluid sensor being fluidly coupled to said control circuit, said control circuit receiving said off input when said fluid sensor senses fluid.

5. The assembly according to claim 2, further comprising a pump being positioned within said canister, said pump having an inlet and an exhaust, said inlet drawing fluid inwardly therein when said pump is turned on, said exhaust of said pump being fluidly coupled to said fluid output in said outer wall of said canister for spraying the fluid outwardly from said fluid output when said pump is turned on, said pump being electrically coupled to said control circuit.

6. The assembly according to claim 5, further comprising a button being movably coupled to said outer wall of said canister, said button being electrically coupled to said control circuit, said pump being turned on when said button is depressed, said pump being turned off when said button is released.

7. The assembly according to claim 2, further comprising a first canister contact being coupled to said bottom wall of said canister, said first canister contact being electrically coupled to said control circuit, said first canister contact being in electrical communication with said first base contact when said canister is positioned in said well in said base.

8. The assembly according to claim 7, further comprising a second canister contact being coupled to said bottom wall of said canister, said second canister contact being electrically coupled to said control circuit, said second canister contact being in electrical communication with said second base contact when said canister is positioned in said well in said base, said control circuit receiving said fill input when said first canister contact engages said first base contact, when said second canister contact engages said second base contact and when said canister engages said contact sensor.

9. The assembly according to claim 2, further comprising a power supply being positioned within said canister, said power supply being electrically coupled to said control circuit, said power supply comprising at least one battery.

10. The assembly according to claim 1, further comprising an air exhaust tube being positioned in said canister, said air exhaust tube extending through said bottom wall of said canister, said air exhaust tube being fluidly coupled to said air release valve when said canister is positioned in said well in said base, said air exhaust tube exhausting air from within said canister when said canister is filled with fluid.

11. The assembly according to claim 10, further comprising an exhaust valve being fluidly coupled to said air exhaust tube, said exhaust valve being positioned within said canister having said exhaust valve being positioned adjacent to said top wall of said canister, said exhaust valve passing air in only one direction wherein said exhaust valve is configured to inhibit air from entering said canister through said air exhaust tube, said exhaust valve being positioned closer to said top wall of said canister than said fluid sensor such that said canister ceases being filled with the fluid before the fluid level reaches said exhaust valve.

12. The assembly according to claim 1, further comprising an intake valve being positioned within said canister, said intake valve being in fluid communication with said air input in said outer wall of said canister, said intake valve passing air in only one direction wherein said intake valve is configured to inhibit air from exiting said canister through said air input.

13. A tubeless sprayer assembly being configured to be positioned adjacent to a sink for spraying water, said assembly comprising:

a base being coupled to a support surface having said base being positioned adjacent to a sink, said base having a fluid port being integrated therein, said fluid port being fluidly coupled to a fluid source wherein said fluid port is configured to receive a fluid from the fluid source, said base having a top side and a bottom side, said top side having a well extending toward said bottom side, said well having a lower bounding surface, said fluid port extending through said bottom side and said lower bounding surface;

a fluid valve being coupled to said base, said fluid valve being in fluid communication with said fluid port, said fluid valve closing said fluid port when said fluid valve is turned off, said fluid port opening said fluid port when said fluid valve is turned on;

a first base contact being coupled to said lower bounding surface of said well, said first base contact surrounding said fluid port;

a second base contact being coupled to said lower bounding surface of said well, said second base contact surrounding said fluid port, said fluid valve being electrically coupled to each of said first base contact and said second base contact;

an air release valve being integrated into said base, said air release valve being aligned with said lower bounding surface of said well, said air release valve restricting air from flowing in therethrough in a first direction;

a contact sensor being coupled to said base, said contact sensor being electrically coupled to said first base contact;

a canister being positionable in said base, said canister being in fluid communication with said fluid port when said canister is positioned in said base to fill said canister with the fluid, said canister having a bottom wall, a top wall and an outer wall extending therebetween, said bottom wall resting on said lower bounding surface of said well when said canister is positioned in said base, said canister having an air input extending through said outer wall into an interior of said canister, said canister having a fluid output extending through said outer wall into said interior of said canister, said bottom wall of said canister engaging said contact sensor when said canister is positioned in said well in said base; and a pumping unit being coupled to said canister, said pumping unit pumping the fluid outwardly from said canister when said pumping unit is turned on wherein said pumping unit is configured to facilitate the fluid to be sprayed without a connection to the fluid source, said pumping unit comprising:

a control circuit being coupled to said canister, said control circuit receiving a fill input and an off input;

a fill spout extending through said bottom wall of said canister, said fill spout being fluidly coupled to said fluid port in said base when said canister is positioned in said well in said base for filling said canister with the fluid;

a fill valve being fluidly coupled to said fill spout, said fill valve being positioned within said canister, said fill valve passing fluid in only one direction when said fill valve is turned on wherein said fill valve is configured to inhibit fluid from exiting said canister through said fill spout, said fill valve being in a closed condition when said fill valve is turned off, said fill valve being electrically coupled to said control circuit, said fill valve being turned on when said control circuit receives said fill input and does not receive said off input, said fill valve being turned off when said control circuit receives said off input;

a fluid sensor being positioned within said canister, said fluid sensor being positioned adjacent to said top wall of said canister, said fluid sensor being fluidly coupled to said control circuit, said control circuit receiving said off input when said fluid sensor senses fluid;

an air exhaust tube being positioned in said canister, said air exhaust tube extending through said bottom wall of said canister, said air exhaust tube being fluidly coupled to said air release valve when said canister is positioned in said well in said base, said air exhaust tube exhausting air from within said canister when said canister is filled with fluid;

an exhaust valve being fluidly coupled to said air exhaust tube, said exhaust valve being positioned within said canister having said exhaust valve being positioned adjacent to said top wall of said canister, said exhaust valve passing air in only one direction wherein said exhaust valve is configured to inhibit air from entering said canister through said air exhaust tube, said exhaust valve being positioned closer to said top wall of said canister than said fluid sensor such that said canister ceases being filled with the fluid before the fluid level reaches said exhaust valve;

an intake valve being positioned within said canister, said intake valve being in fluid communication with said air input in said outer wall of said canister, said intake valve passing air in only one direction wherein said intake valve is configured to inhibit air from exiting said canister through said air input;

a pump being positioned within said canister, said pump having an inlet and an exhaust, said inlet drawing fluid inwardly therein when said pump is turned on, said exhaust of said pump being fluidly coupled to said fluid output in said outer wall of said canister for spraying the fluid outwardly from said fluid output when said pump is turned on, said pump being electrically coupled to said control circuit;

a button being movably coupled to said outer wall of said canister, said button being electrically coupled to said control circuit, said pump being turned on when said button is depressed, said pump being turned off when said button is released;

a first canister contact being coupled to said bottom wall of said canister, said first canister contact being electrically coupled to said control circuit, said first canister contact being in electrical communication with said first base contact when said canister is positioned in said well in said base;

a second canister contact being coupled to said bottom wall of said canister, said second canister contact being electrically coupled to said control circuit, said second canister contact being in electrical communication with said second base contact when said canister is positioned in said well in said base, said control circuit receiving said fill input when said first canister contact engages said first base contact, when said second canister contact engages said second base contact and when said canister engages said contact sensor; and a power supply being positioned within said canister, said power supply being electrically coupled to said control circuit, said power supply comprising at least one battery.

* * * * *